United States Patent [19]

Flanagan

[11] Patent Number: 4,465,226

[45] Date of Patent: Aug. 14, 1984

[54] PAPERBOARD TRAY CORNER CONSTRUCTION

[75] Inventor: Thomas L. Flanagan, Killingworth, Conn.

[73] Assignee: Standard-Knapp, Inc., Portland, Conn.

[21] Appl. No.: 352,801

[22] Filed: Feb. 26, 1982

[51] Int. Cl.[3] ..... B65D 5/26

[52] U.S. Cl. ..... 229/32; 229/34 R; 229/35

[58] Field of Search ..... 229/32, 35, 45, 33, 229/39 R, 34 A, 34 B

[56] References Cited

U.S. PATENT DOCUMENTS

| | | | |
|---|---|---|---|
| 1,493,181 | 5/1924 | Zwick | 229/32 |
| 2,265,326 | 12/1941 | Stopper | 229/33 |
| 2,424,716 | 7/1947 | Smart | 229/32 |
| 2,858,058 | 10/1958 | Kitchell | 229/45 |
| 3,416,288 | 12/1968 | Coons | 206/597 |
| 3,474,901 | 10/1969 | Viater | 229/32 |
| 3,837,562 | 9/1974 | Cali | 229/32 |
| 3,841,476 | 10/1974 | Elford | 229/32 |
| 4,114,798 | 9/1978 | Gardner | 229/32 |

*Primary Examiner*—Steven M. Pollard
*Assistant Examiner*—Bryon Gehman
*Attorney, Agent, or Firm*—McCormick, Paulding and Huber

[57] ABSTRACT

A paperboard tray blank has minimum height h in relation to the diameter D of the cans in the tray such that this diameter is equal to or greater than three times said height. The tray is formed from the blank by gluing corner tabs to the side walls or flaps, and the glue joint is compressed in a unique compression unit. The corner tabs have a length greater than the height h of the side and end walls so that the corners of the tray are provided with a tapered configuration which results in the ends of these corner tabs being engageable with the cans within the tray. The compression unit yieldably engages the outside of the tray to set the glue.

6 Claims, 6 Drawing Figures

PAPERBOARD TRAY CORNER CONSTRUCTION

SUMMARY OF THE INVENTION

This invention relates generally to paperboard tray blanks of the type having side and end flaps adapted to being folded upwardly so as to receive a charge or slug of articles, usually cylindrical cans. The cost of the paperboard material has become high enough to warrant minimizing the height of these tray flaps so as to minimize the quantity of paperboard material required in the making up of a typical package. Shrink film wrapping is generally provided around the product in the paperboard tray but the application of the shrink film forms no part of the present invention.

In a conventional paperboard tray the height of the side and end walls is dictated by the depth of a laterally open slot provided adjacent each of the corners of the tray blank, and lines of weakening or score lines are generally provided at some predetermined distance for the marginal edges of the blank, corresponding to the depth of these slots. The leading and trailing end flaps are generally bent upwardly in a preliminary step during the formation of the tray, and the side and end flaps are then folded upwardly to form a tray and to permit the application of pressure to set the glue between these corner tabs and the forward and leading end portions of these side flaps.

In the present invention the tray blank is adapted to hold product, in the form of cans or other cylindrical articles, having a diameter D which is related to the height of the side and end flaps in the ratio of three to one or less. L-shaped slots are formed adjacent the corners of the tray blank with each slot having one leg aligned with the line of weakening between the bottom panel of the tray blank and one of said end flaps, and having its outer leg generally aligned with the line of weakening between said bottom panel and the side flap. This latter leg has a maximum width such that one side of the slot leg is aligned with the line of weakening and the other side is aligned with a short line of weakening forming a corner tab such that the corner tab has a depth h plus $\Delta$ where $\Delta$ corresponds to the maximum width of this leg of the L shaped slot.

The above mentioned tray configuration permits the folding up of a paperboard tray such that the end portions of the corner tab are located adjacent to the periphery of the cylindrical can in the tray with the result that compression exerted against the side walls or flaps of the tray can set the glue between the ends of these side flaps and the corner tab itself.

The present invention also encompasses a unique compression unit especially suited for applying side pressure to a folded and glued tray blank, which tray may have irregularly shaped end portions in that these end portions are slightly tapered rather than being square as is the case in a conventional rectangular tray.

DETAILED DESCRIPTION

Figure 1:
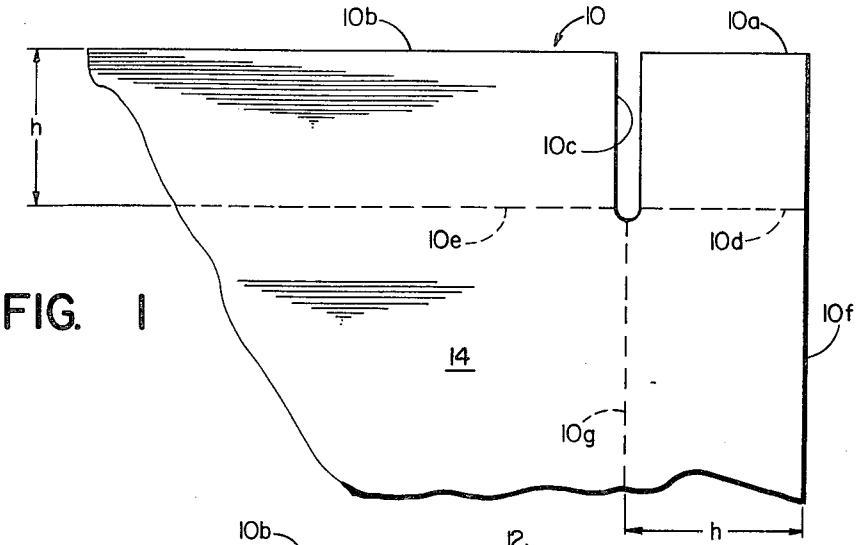
FIG. 1 is a plan view of one corner of a generally rectangular four cornered tray blank of the type found in the prior art.
Figure 2:
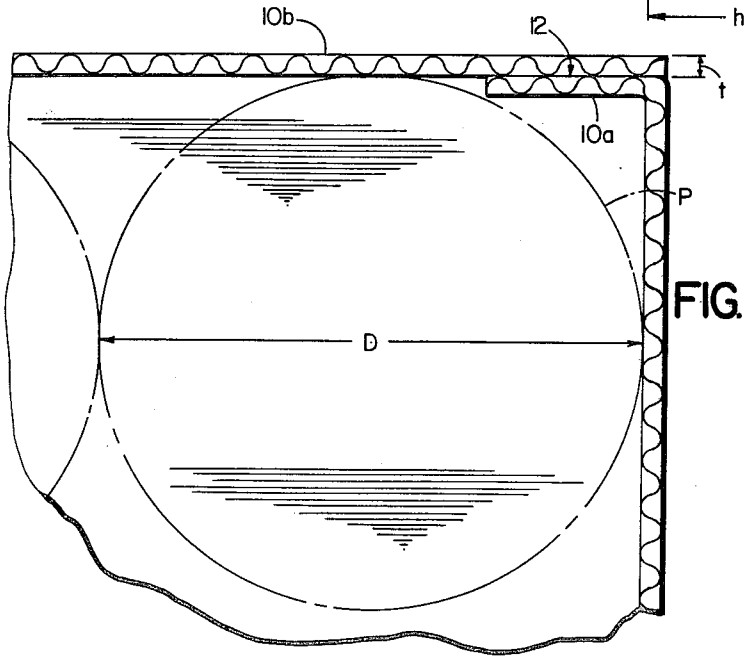
FIG. 2 is a plan view of the prior art tray blank depicted in FIG. 1, but folded up and glued in a conventional fashion (except for the fact that the height of the tray H is equal to or less than one-third the diameter of the product P, an uncoventional limitation).

Turning now to the drawings in greater detail, FIGS. 1 and 2 show a conventional paperboard tray blank 10 of the type adapted to hold a plurality of articles such as cans or the like in order that further packaging can be accomplished, as for example of surrounding the package suggested in FIGS. 1 and 2 with a shrink film wrapping. More particularly, FIG. 1 shows a tray blank prior to its being folded into the configuration for wrapping the product and tray with such a shrink film. Although only one corner of the tray 10 is illustrated in FIG. 1 it will be apparent that the other three corners are similarly constructed. The tray blank includes a bottom panel 14 defined by mutually perpendicular lines of weakening **10*e* and 10*g*, oppositely paired with respect to one another so as to define a generally rectangular bottom panel 14. Side flaps 10*b* are integrally connected to the sides of the bottom panel 14 along lines of weakening such as that shown at 10*e*. End flaps 10*f* are similarly connected integrally to the ends of the bottom panel 14 along lines of weakening such as that illustrated at 10*g***.

The dimension "h" in FIG. 1 illustrates the ultimate height for the tray (less some minimal difference due to the thickness of the paperboard blank "t" and this dimension "h" is defined for purposes of this application as being the spacing between the outer marginal edges of the side and end flaps and the lines of weakening **10*e* and 10*g***.

FIG. 2 illustrates the relative size of the cans or product P to be packaged in a tray of the type shown in FIG. 1 and for purposes of comparison FIG. 2 shows this diameter D for the product P as being approximately three times the dimension "h" referred to previously.

In utilizing a tray 10 of these dimensions to package cans of the size illustrated in FIG. 2 it will be apparent that the can periphery does not touch the corner tab **10*a*, after folding up of the side and end flaps and gluing of the corner tab and the end portion of the side flap as illustrated generally at 12 in FIG. 2. Consequently, even though a tray such as that illustrated in FIG. 2 be moved through a conventional compression unit (not shown) the glue 12 will not be set properly due to the fact that the periphery of the can P affords no backup or reaction surface to the pressure exerted on the external side flap 10*b*** in a conventional compression unit.

Figure 3:
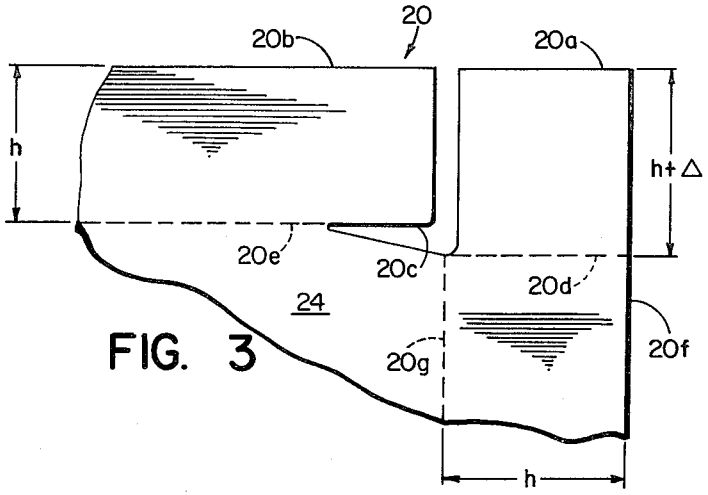
FIG. 3 is a plan view similar to FIG. 1 but illustrating one corner of an improved tray blank having a generally rectangular configuration with four corners of the type depicted in FIG. 3.
Figure 4:
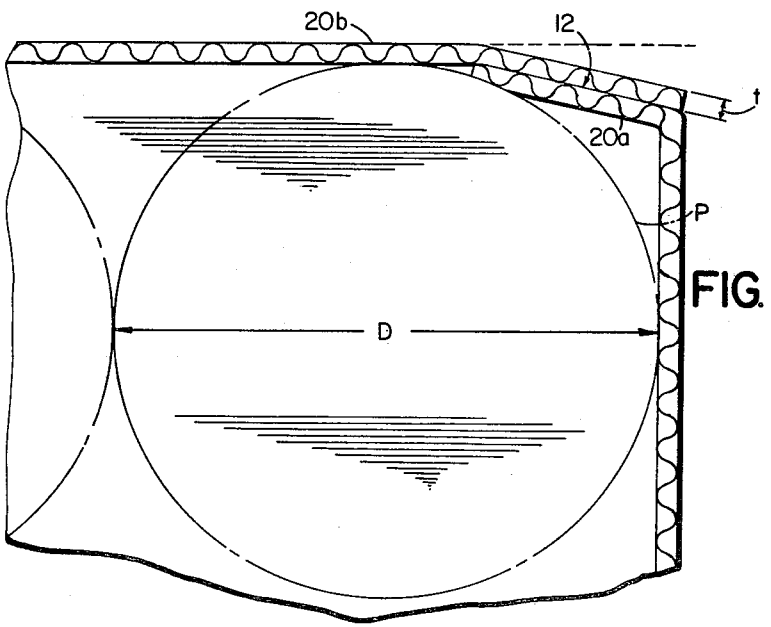
FIG. 4 is a plan view of the tray blank illustrated in FIG. 3 but with the side and end flaps folded upwardly, and with the corner tab glued in place so as to hold a plurality of cylindrical articles within the tray.

FIGS. 3 and 4 illustrate an improved tray blank 20 constructed of the same material as that referred to in the foregoing description of FIGS. 1 and 2. The tray blank 20 has a thickness "t" as suggested in FIG. 4 and is intended to be used with cans or product of a diameter equal to or less than three times the dimension "h" of the side and end flaps. In order to avoid the problem referred to in the preceding paragraph with respect to a conventionally cut tray blank, the blank of FIG. 3 includes generally L-shaped slots 20c formed adjacent to the corners of the tray blank 20. Each L-shaped slot has one leg aligned with a line of weakening 20g between the bottom panel 24 and the end flap 20f. This leg of the slot 20c is somewhat deeper than the slot 10c illustrated in the prior art tray blank of FIG. 1. This increase in depth is illustrated by the dimension h plus Δ in FIG. 3. It should be noted that the distance between the side and end flaps with respect to the lines of weakening 20e and 20g in FIG. 3 still comprises the dimension "h" referred to previously with reference to FIGS. 1 and 2. That is, the dimension "h" is such that the ratio $D/h \leqq 3$.

Still with reference to the L-shape slot 20c each of these slots has its other leg perpendicular to the first mentioned leg and aligned generally with the line of weakening 20e associated with the bottom panel 24 and the side flap 20b. Furthermore, this last mentioned leg of the L-shaped slot 20c has a tapered width such that one side of said slot (the outer side) is in fact aligned with the line of weakening 20e, and the other side of said slot is so tapered that its widest point is generally aligned with a short line of weakening segment 20 *d* extending across the end flap 20f and spaced from the outer marginal edge of side flap 20b by the above mentioned dimension h plus Δ. This line of weakening 20d defines a corner tab 20a, which corner tab has a lateral dimension h plus Δ greater than the lateral dimension "h" of the corner tab 10a referred to in the otherwise conventional prior art tray blank of FIG. 1.

When the tray blank 20 of FIG. 3 is folded up to hold the product, as for example the cans P, P (each of diameter D) it will be apparent that a different construction for the corner portion of the tray is achieved. Glue is still applied between the surface of the corner tab 20a and the adjacent inside surface of the side flap 20b. This glue is illustrated generally at 12 both in FIG. 2 and FIG. 4. However, the corner tab 20a extends inwardly from the forward or leading edge of the folded up tray defined by the end flap 20f a sufficient distance (h plus Δ) so as to afford a backup or reaction surface against which a compression unit (see FIG. 5) can act against the periphery of the corner can P to set the glue 12 and thereby provide a more secure package for the product. It is also noted that this corner portion of the folded up tray does have tapered ends, as suggested in FIG. 4.

Figure 5:
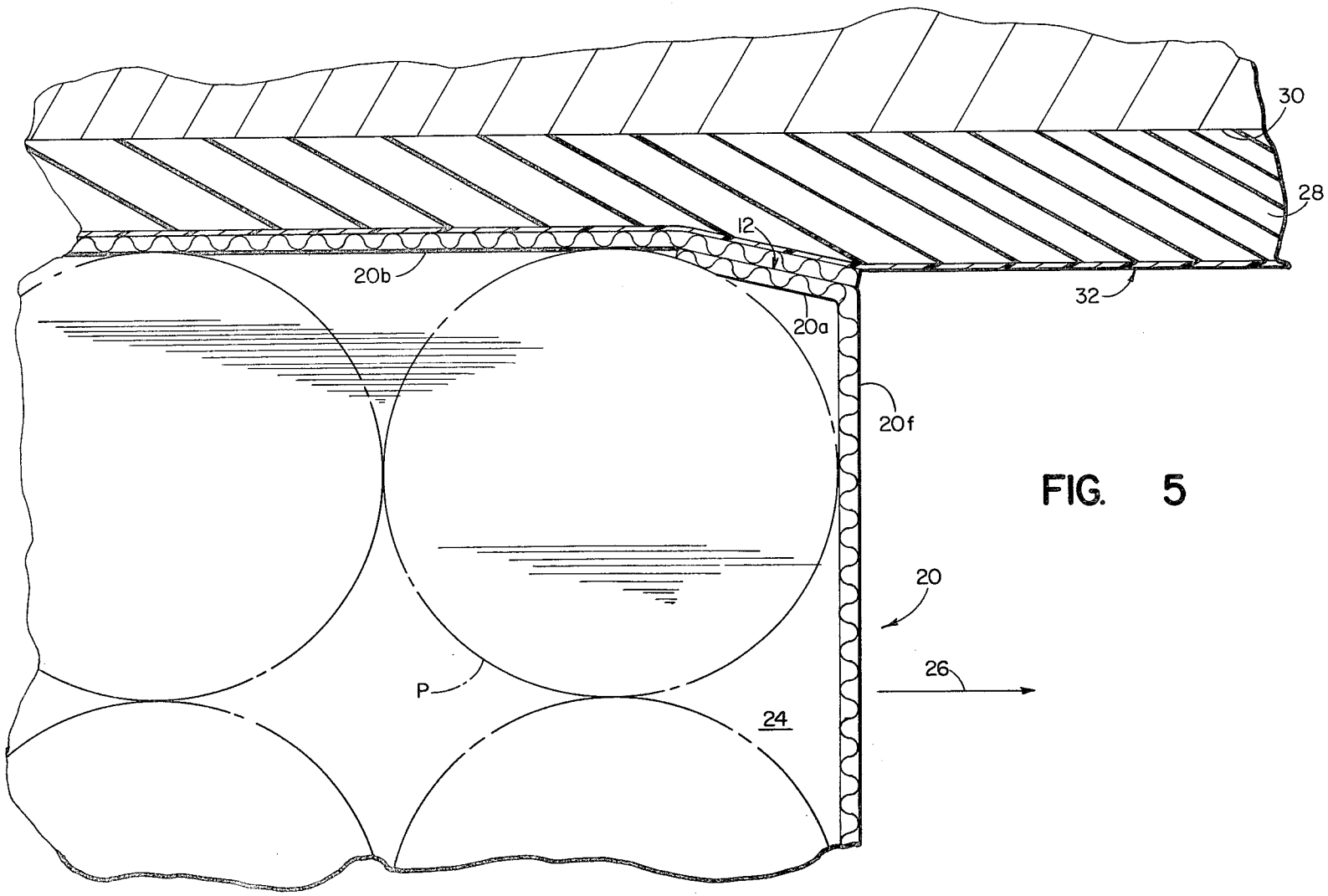
FIG. 5 is a plan view of an improved tray compression section or unit, such as might be utilized for setting the glue in the tray of FIG. 4.
Figure 6:
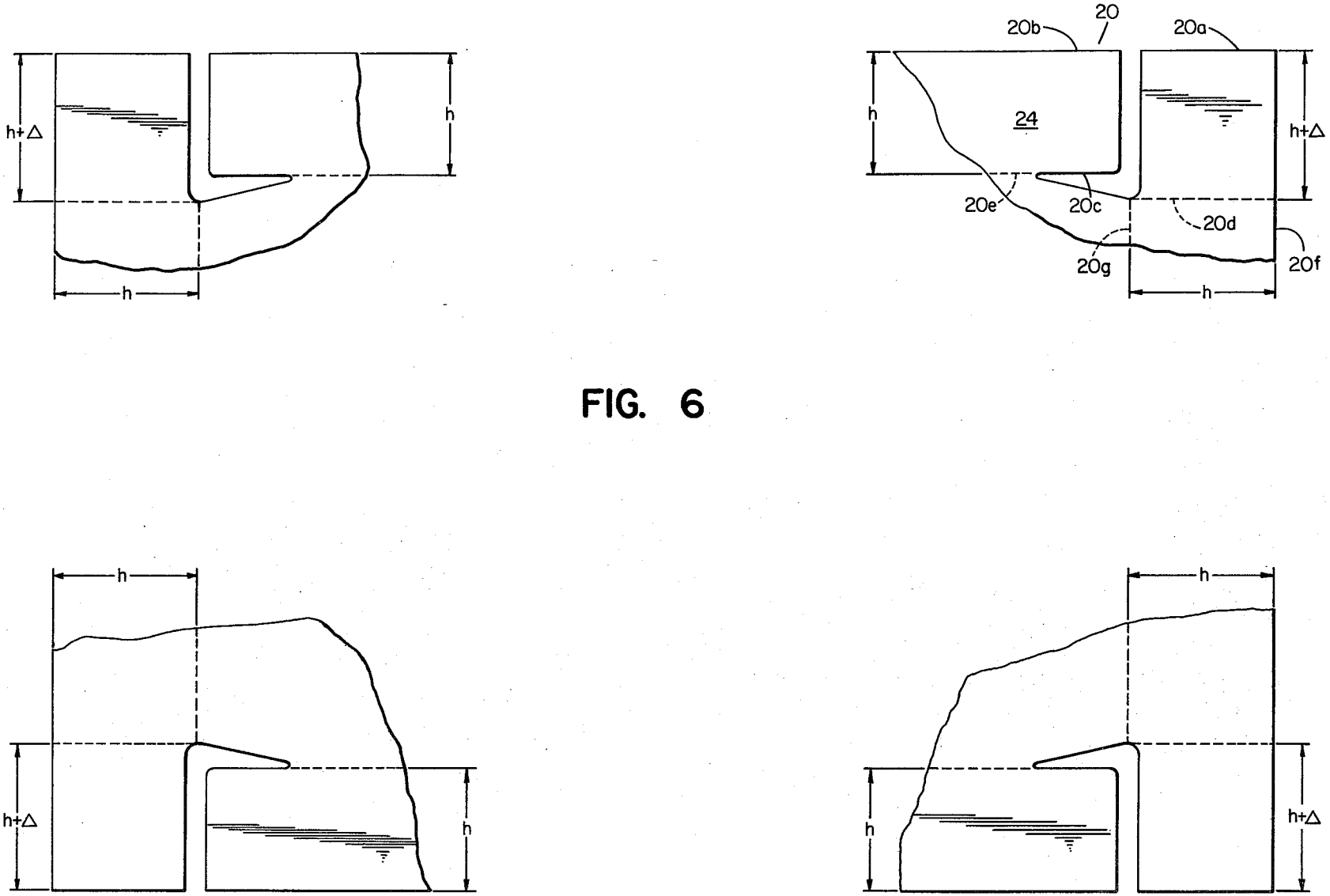
FIG. 6 is a fragmentary plan view showing the four corners of a tray blank.

Turning next to a description of the FIG. 5 compression unit for achieving this compressive force in the area of the glue joint 12 FIG. 5 shows the folded up tray blank of FIG. 4 in the process of being moved in the direction of the arrow 26 between opposed compressible elements 28 (one shown). As so constructed and arranged an inward force is exerted against the slot defining side flaps 20b and the corner tab 20a to compress the glue between said slide flap 20b and the tab 20a. Conventional means is provided for advancing the tray 20 and its product P through this compression unit or section, and the resilient compressive elastomeric elements 28 may each comprise an elastomeric material 28 backed up by rigid side walls 30. In order to assist the tray advancing means in moving the tray 20 in the direction of the arrow 26, that is to facilitate compression of the element 28 and achievement of the necessary compressive force to set the glue in the area 12 of the corners of the tray, a low friction plastic skin 32 of polytetrafluoroethylene or the like is provided on the outer face of each compressive elastomeric element 28. These elements 28 are preferably formed from an elastomeric material having sufficient resiliency to allow the trays to be advanced therebetween. In their uncompressed condition these elements 28 define a path for the trays, which path has a lateral width at least two times the dimension Δ less than the overall tray width in the lateral direction.

I claim:

1. A generally rectangular tray blank for packaging cylindrical articles of diameter D, said blank consisting of a generally rectangular bottom panel with sides and ends defined by lines of weakening, oppositely paired side and end flaps integrally connected to said bottom panel and said sides and ends thereof respectively, said side and end flaps having outer marginal edges spaced from said lines of weakening by a dimension h such that the ratio D/h is equal to or less than three to one, each side flap having end portions defining L-shaped slots adjacent the corners of said tray blank, each L-shaped slot having one leg aligned with the line of weakening between said bottom panel and one of said end flaps, and each L-shaped slot having its other leg generally aligned with the line of weakening between said bottom panel and one of said side flaps, said other leg of each L-shaped slot having a slot width Δ such that one side of said other leg slot width Δ is aligned with the line of weakening between said bottom panel and said one side flap, and the other side of said other leg slot width Δ being aligned with a line of weakening across said end flap and which is spaced from the end of said end flap by a distance h plus Δ to define a corner tab.

2. The tray blank of claim 1 wherein said blank has a thickness t such that the ratio Δ/t is greater than one.

3. The blank of claim 1 wherein said other leg slot width Δ is tapered from a minimum width at the end of said associated L-shaped width to a maximum width Δ at the juncture between said L-shaped slot legs.

4. The blank of claim 1 wherein said side and end flaps are folded upwardly along their associated lines of weakening and wherein said end portions of said folded side flaps abut the in-folded corner tabs so that glue provided on the flap surfaces therebetween hold these flaps at right angles to said bottom panel.

5. The blank of claim 4 wherein said other leg slot width Δ is tapered from a minimum width at the end of said associated L-shaped width to a maximum width Δ at the juncture between said L-shaped slot legs.

6. The blank of claim 5 wherein said in-folded corner tabs and said end portions of said folded side flaps form laterally inwardly tapered corners for the folded tray.

* * * * *